US007946864B1

(12) United States Patent
Neyens

(10) Patent No.: US 7,946,864 B1
(45) Date of Patent: May 24, 2011

(54) RETRACTABLE OUTDOOR ELECTRICAL POWER RECEPTACLE

(76) Inventor: John Neyens, Quincy, IL (US)

( * ) Notice: Subject to any disclaimer, the term of this patent is extended or adjusted under 35 U.S.C. 154(b) by 0 days.

(21) Appl. No.: 12/693,221

(22) Filed: Jan. 25, 2010

(51) Int. Cl.
*H01R 13/44* (2006.01)

(52) U.S. Cl. ..... 439/131

(58) Field of Classification Search ..... 439/131
See application file for complete search history.

(56) References Cited

U.S. PATENT DOCUMENTS 3,646,244 A * 2/1972 Cole ..... 174/57
3,794,956 A * 2/1974 Dubreuil ..... 439/131

* cited by examiner

*Primary Examiner* — Ross N Gushi
(74) *Attorney, Agent, or Firm* — Brevetto Law Group

(57) ABSTRACT

A retractable outdoor electrical power receptacle that has a top surface plate over a mechanism vault, and a telescoping arm with an electrical power outlet box rigidly mounted on it. The mechanism vault containing the hardware and components of the device is buried in the ground. The top surface plate sits atop the mechanism vault at the ground level with an access hole for accessing the mechanism vault. A protective cover plate covers the access hole, fitting within the top surface. The protective cover plate can be rotated 180 degrees to reveal a gap through which the telescoping arm can extend when the electrical outlets are raised and in use.

14 Claims, 6 Drawing Sheets

RETRACTABLE OUTDOOR ELECTRICAL POWER RECEPTACLE

BACKGROUND

1. Field of the Invention

The present invention relates to electrical power components, and more specifically, to systems and methods of providing a retractable outdoor electrical power receptacle.

2. Description of Related Art

People of all ages enjoy outdoor activities. Families gather in public parks for picnics and daylong outings. Regularly scheduled farmer's markets and outdoor swap meets are popular in cities across the nation. Outdoor concerts and political rallies often attract crowds of thousands, and sometimes tens of thousands or more. The crowds, families and individuals attending these outdoor events require services and amenities such as bathroom facilities, lights, cooking and food storage appliances, audio and video systems, and other electrical devices. Some locations have buildings and infrastructure to meet these needs. As for bathroom facilities, parks and outdoor public recreation properties often have public restrooms in one or more locations within the confines of the property. For special events, such as music concerts and political rallies portable restroom facilities (e.g., porta potties) can be brought in to accommodate the needs of large crowds.

In addition to the need for restroom facilities there is often a need for electricity in the outdoor public spaces to power audio/video systems, cooking/refrigeration appliances, or other electrical devices. For example, concerts and political rallies typically require electricity for the audio and lighting systems. High profile outdoor events sometimes require electricity to power radio and broadcast equipment. If there is a nearby building or permanent restroom facility wired with electricity the event organizers can simply run power lines from the building. However, from time to time events are staged in areas that are not near any permanent buildings or other source of electricity. In such situations the organizers must either provide portable generators—which tend to be quite noisy—or else run power cables from the nearest available source of electricity. Such temporary measures can be time consuming, expensive, unreliable, and sometimes pose safety problems.

The present inventor recognized a need for a robust, adaptable outdoor source of electrical power.

SUMMARY

Embodiments disclosed herein address the above stated needs by providing a retractable outdoor electrical power receptacle that has a top surface plate over a mechanism vault, and a telescoping arm with an electrical power outlet box rigidly mounted on it. The top surface plate typically sits at the ground level and has an access hole for accessing the mechanism vault. The mechanism vault typically extends downward a predetermined length below the ground level and contains the hardware and components of the device. Various embodiments have a protective cover plate shaped to cover the access hole by fitting within the top surface plate and sitting on a support flange connected to the underside of the top surface plate.

The telescoping arm is configured to slide within a guide mechanism along a vertical axis between an up position and a down position. In the up position the top end of the telescoping arm is above the surface level and the bottom end is below the surface level, and the electrical outlets are held above ground in an easily accessible position. When the telescoping arm is in the down position the electrical outlets are stowed away below ground.

BRIEF DESCRIPTION OF THE DRAWINGS

The accompanying drawings, which are incorporated in and constitute part of the specification, illustrate various embodiments of the invention. Together with the general description, the drawings serve to explain the principles of the invention. In the drawings.

DETAILED DESCRIPTION

Figure 1B:
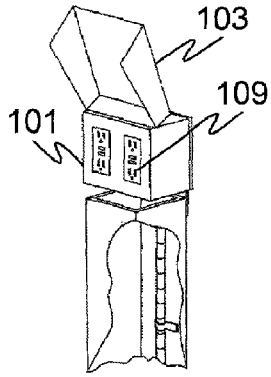
FIG. 1B is a cutaway view depicting the telescoping arm and outlet box according to various embodiments.
Figure 1A:
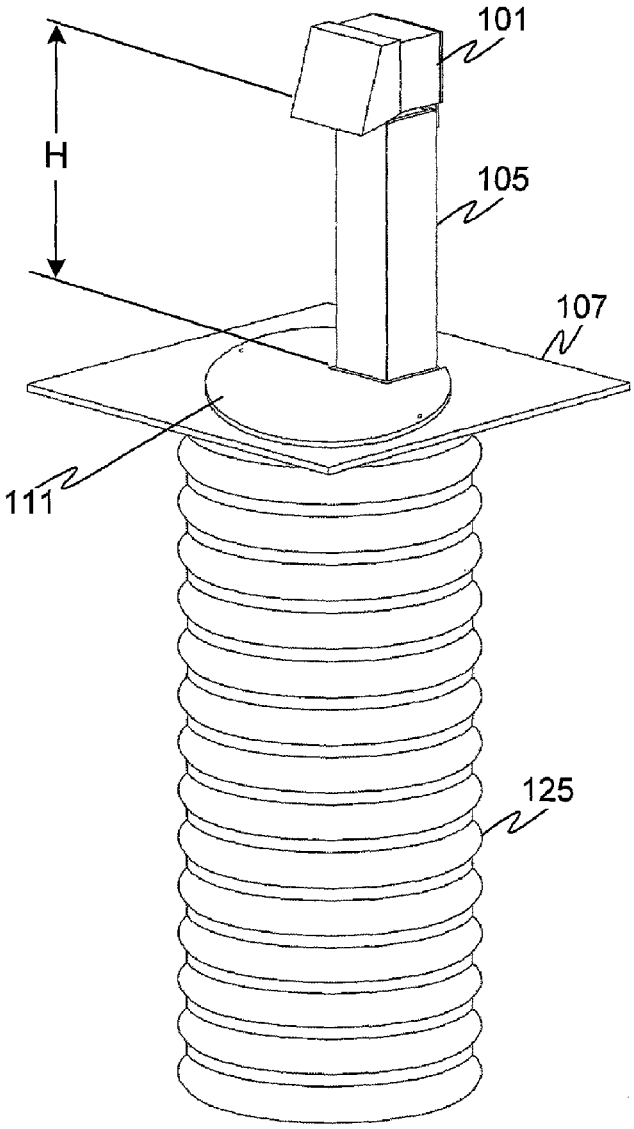
FIG. 1A is an oblique view of an embodiment of the present invention.

FIG. 1A is an oblique view of an embodiment of the present invention. The embodiments disclosed herein address the need recognized by the inventor for reconfigurable electrical power outlets suitable for outdoor placement in public spaces, e.g., public parks, sports fields, open fields, or outdoor recreation facilities. The electrical power outlets according to the various embodiments can be readily reconfigured from underneath a protective cover to an "up" position, standing above the ground at a convenient height. The electrical outlets provided in the "up" position are approximately the same height as electrical outlets inside buildings and houses that are often located a foot or so above the floor level. This allows convenient user access without requiring the user to bend all the way down to the floor to reach the outlet. This location for indoors wall receptacles—approximately a foot above the floor level—also tends to be more visible than outlets that are mounted flush against the floor or at lower positions near the floor. As shown in FIG. 1A, various embodiments can provide an electrical power outlet box 101 at a convenient height "H" above the surface level of top surface plate 107 of the device.

The device is typically buried in the ground so that the top surface plate 107 remains stationary at, or near, ground level. A mechanism vault 125 may be constructed from a drum with ribbed sides for added structural support. The ribbed sides enable the device to be more firmly implanted in the ground either in hard packed soil or embedded in concrete. In some instances the device may have concrete poured around it to provide additional support and cement it firmly into place. The mechanism vault 125 may be waterproof to avoid shorting out the electrical lines running to the electrical outlets 109.

FIG. 1B is a cutaway view depicting the telescoping arm 105 and outlet box 101. To protect the electrical power outlets 109 some embodiments are provided with a box cover 103. The box cover 103 may be hinged so that it can be flipped up when a user is plugging in, or unplugging, a power cord to one of the electrical outlets 109. In order to accommodate a power cord the box cover 103 provides some space underneath. The bottom of box cover 103 is typically open so that a cord can pass through, providing a power cord aperture when the box cover 103 is in the "down" position. In this way, once the power cord (e.g., an extension cord or the power cord of an electrical appliance) is plugged into electrical outlet 109 the box cover 103 can be flipped down over the power cord end, or plug, to protect it from the elements.

In FIG. 1B the electrical outlet box 101 faces inward, towards the center of cover plate 111. Depending upon the situation in which the device is being installed the electrical outlet box 101 may be configured to face any direction, or even in an upward direction. In some embodiments the electrical outlet box 101 may be adjustable, having the ability to be rotated around to the direction it is most useful. For those embodiments in which the electrical outlet box 101 is pointed outward (opposite that shown in FIGS. 1A-B) the box cover 103 may be removed (or flipped up) before retracting the telescoping arm 105 back into the "down" position to a level beneath the protective cover plate 111.

Figure 2A:
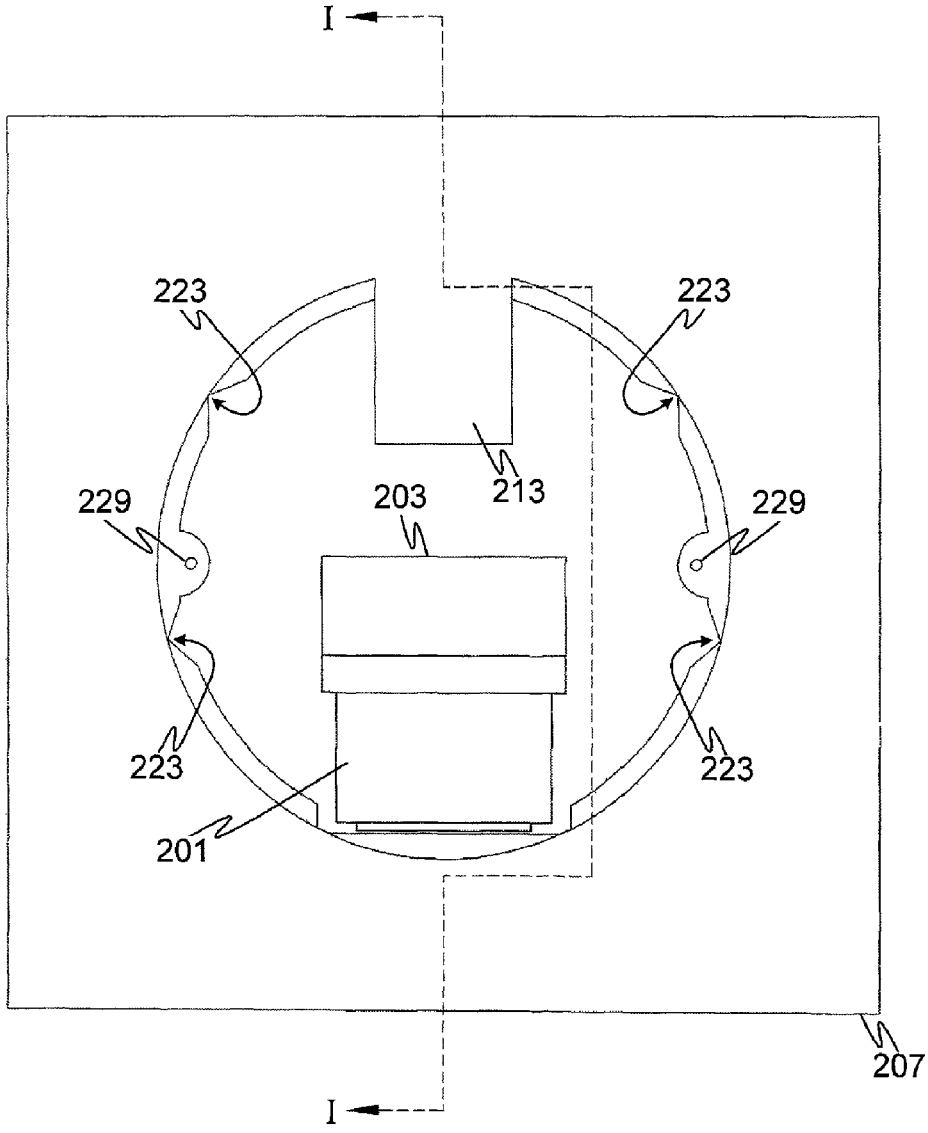
FIG. 2A depicts a top view of the top surface plate.
Figure 2B:
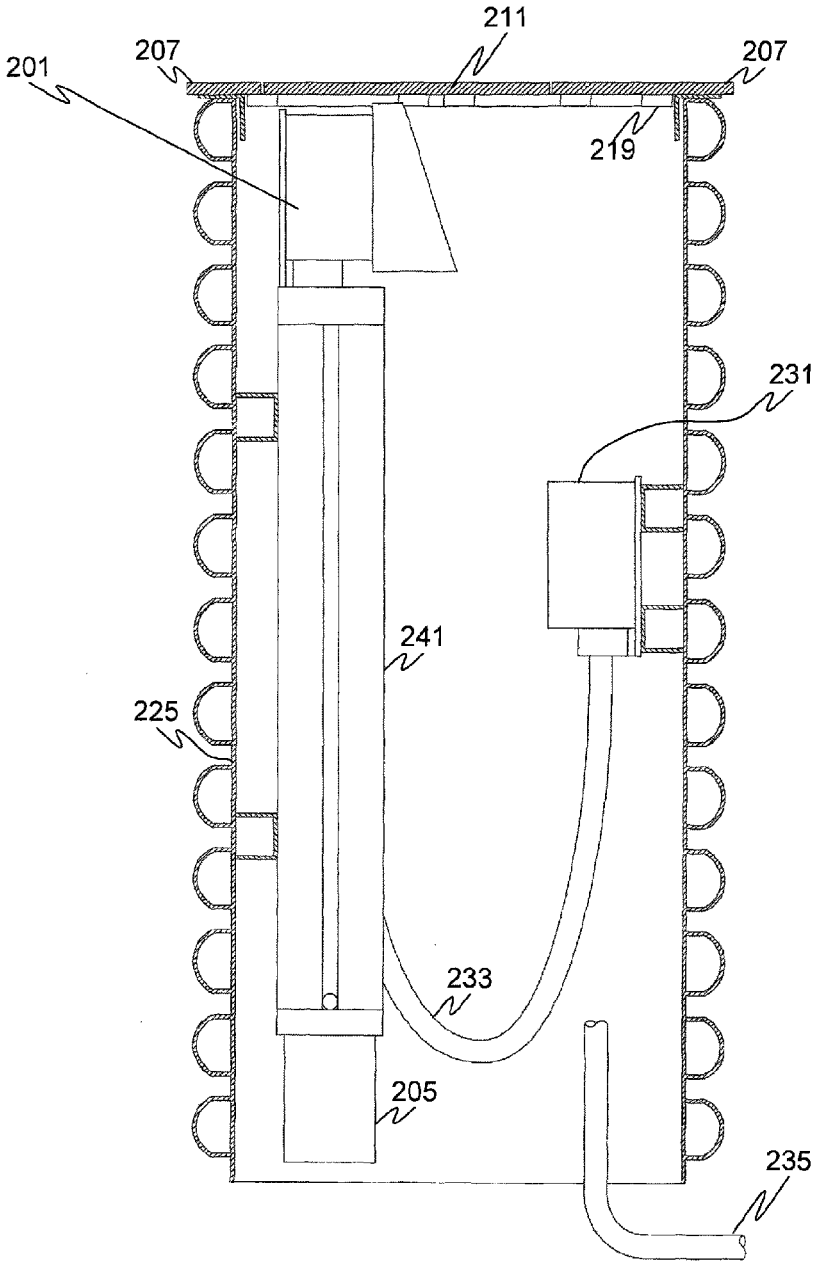
FIG. 2B depicts a cutaway side view with the telescoping arm in the "down" position according to various embodiments taken from cross-section I-I of FIG. 2A.

FIG. 2A depicts a top view of the top surface plate 207, the electrical outlet box 201, and the box cover 203. The protruding protuberance 213 may be seen from a different angle in FIG. 3C as protuberance 313. Returning to FIG. 2A, protuberance 213 fits in a similarly shaped gap in the protective cover 311 shown in FIGS. 3A-B. The protruding protuberance 213 is roughly the same size and shape as the cross-section of telescoping arm 105. When the telescoping arm 105 is in the down position, as shown in FIG. 2B, the protective cover 211 is placed over the access hole in top surface plate 207, with the gap in the protective cover fitted around the protruding protuberance 213. This allows the upper surface level of protective cover 211 to be level with the upper surface level of top surface plate 207, as can be seen in FIG. 2B.

Figure 2C:
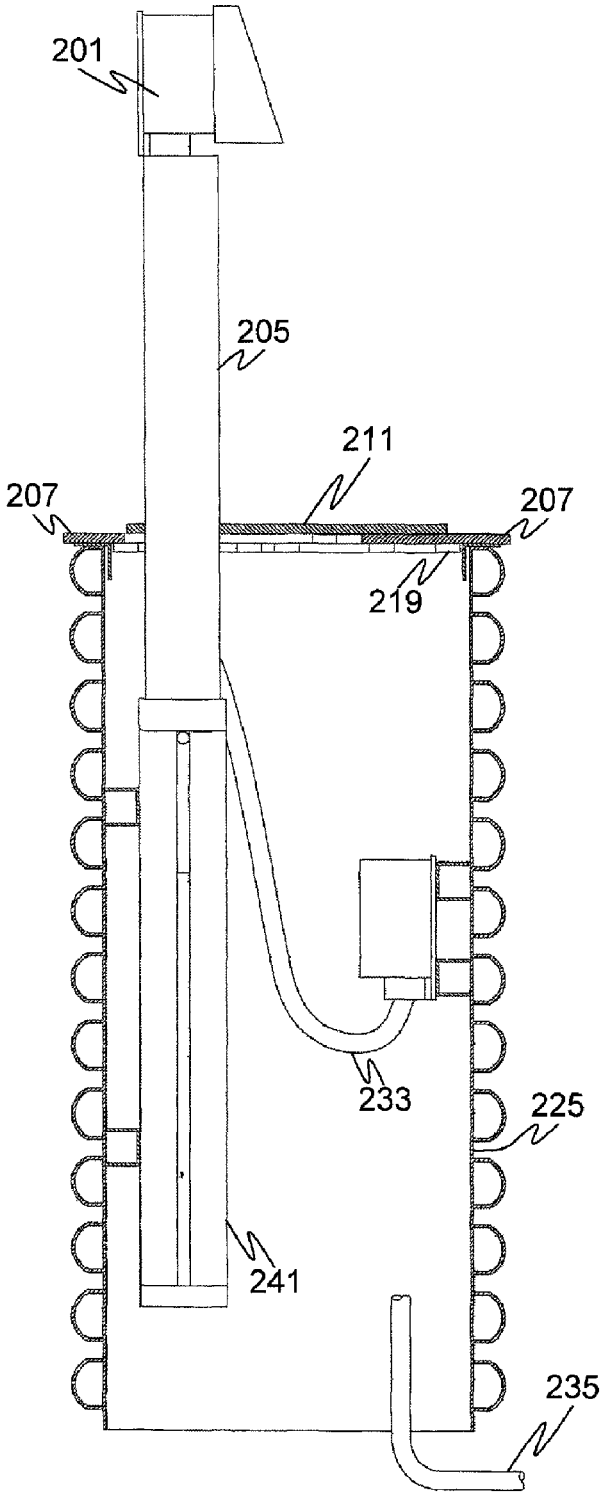
FIG. 2C depicts a cutaway side view taken from cross-section I-I of FIG. 2A showing the telescoping arm in the "up" position according to various embodiments.

FIG. 2B depicts a cutaway side view taken from cross-section I-I of FIG. 2A showing the telescoping arm in the "down" position according to various embodiments. The underside of protective cover 211 rests on support flange 219 when telescoping arm 205 is in the down position. When the telescoping arm 205 is in the up position, as shown in FIG. 2C, the protective cover 211 sits slightly higher than when it is in the down position. The protective cover 211 has guide rests that fit within the support flange 219 when the telescoping arm 205 is down and the protective cover plate 211 is covering up the access hole. In this position—the down position shown in FIG. 2B—the top surface of protective cover plate 211 is level with top surface plate 207. The cooperative shapes of the protective cover 211, the access hole in top surface place 207, and the protuberance 213 may be seen in FIGS. 3A-C.

As shown in FIG. 2B when the electrical power outlet box 201 is not being used it may be lowered into a "down" position, with a sturdy, protective cover plate 211 fastened over the top of electrical outlet box 201, as shown in FIG. 2B. Typically, the protective cover plate 111 is flat, and when the device is in the down position, the upper surface of cover plate 211 is configured to be flush with top surface plate 207 which is flush with the ground level. For those embodiments in which the cover plate 111 sits flush against the ground, the maintenance crews need not take any extra effort to mow around the device. Motorized vehicles such as lawn mowers can simply be driven across the protective cover plate 211 without damaging either the mower or the present device. Typically, the various embodiments provide a latch mechanism or removable bolts that hold the protective cover plate down when not in use to avoid having the plate flip up if a vehicle runs over the top of it, or a person steps on it.

In order to use the electrical outlets the various embodiments are reconfigurable so that a telescoping arm may be lifted and fixed into the "up" position, thus providing access to the outlets. Some embodiments have only two positions, an "up" position and a "down" position. Other embodiments may have multiple "up" positions, for example, a low "up" position with the outlet just above the ground level, a medium "up" position, and a more fully extended, high, "up" position with the outlet positioned a foot or more above the ground level. Some embodiments have one or more fixed "up" position (e.g., low, medium and high). In other embodiments the height of the outlet box is adjustable to any position. In these adjustable embodiments the telescoping arm is held up by pressure from a latch mechanism or an adjustment bolt that can be tightened to affix the telescoping arm at a desired height. As mentioned above, the ability to raise the outlet to a predefined height above ground level makes the device easier to access. The device is also more visible when the outlet is set in the "up" position above the ground level. Since the device may be located out in a field or open area, this makes the electrical outlet easier to spot by a person unfamiliar with the exact location. In this way, the maintenance personnel of the area (e.g., park employees) can position the device in its "up" state for an upcoming event that will need electricity such as an outdoor concert. Then when the concert equipment arrives the equipment workers (e.g., roadies) will be able to easily find the electrical outlets according the various embodiments disclosed herein which have been positioned above ground level for their needs.

FIGS. 2B and 2C depict typical electrical connections found inside the mechanism vault 225. Depending upon the situation where the device is installed, the various embodiments may be implemented in any of several different manners. FIG. 2B shows one typical implementation. To accommodate the movement of telescoping arm 205 which is connected to a source of electrical power, a flexible cable or power cord 233 may be draped from an electrical box 231 located within the mechanism vault 225. The electrical box 231 is typically located at least the same height, or more, above the lower limit (or floor) of the mechanism vault 225 as the distance that the telescoping arm 205 extends upward. Locating electrical box 231 this height within vault 225 allows sufficient slack in power cord 233 for extending the telescoping arm 205. The electrical box 231 is also connected to power cable 235 which serves as a source of electrical power for the electrical outlets. The power cable 235 is typically connected to an electrical fuse box, which in turn, is connected to an electrical transformer or other point on the public power grid suitable for supplying electrical power. Some embodiments are configured such that the act of extending the telescoping arm 205 trips a switch which connects the electrical power outlet box 201 to the source of power within electrical box 231. In these embodiments, when the telescoping arm 205 is in the "down" position its electrical outlets are not powered since the switch is open (off).

Figure 3A:
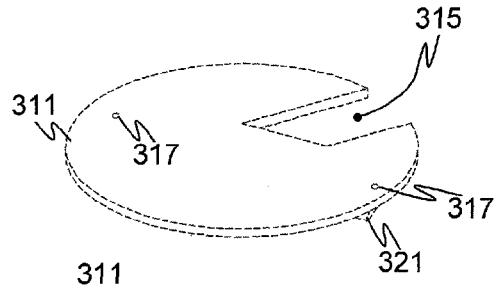
FIGS. 3A-C depicts the top surface and two views of the protective cover plate according to various embodiments.
Figure 3B:
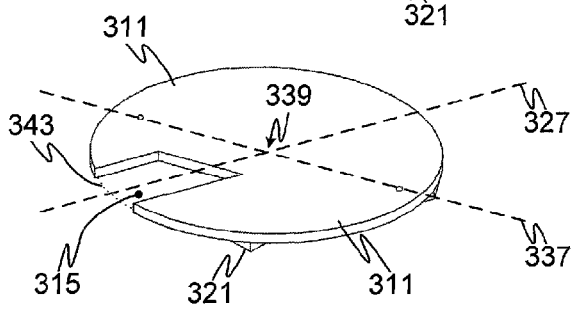
Figure 3C:
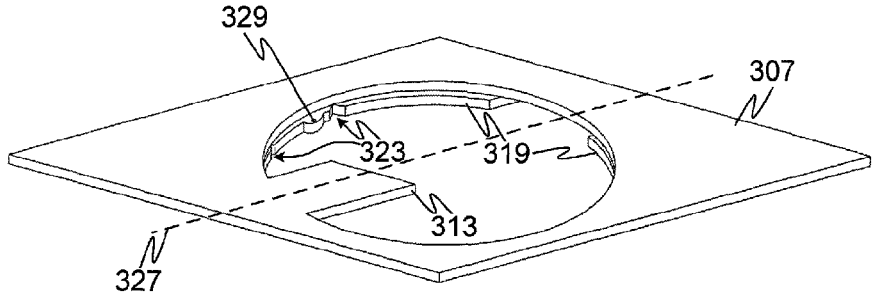

FIGS. 3A-C depicts the top surface plate 307 and two views of the protective cover plate 311. The protective cover 311 has guide rests 321 that fit within the guide rest notches 323 when the device is in the down position and the protective cover 311 is resting on support flange 319. The guide rest notches may be more easily seen in FIG. 2A as guide rest notches 223. When the telescoping arm is down the protective cover 311 of FIG. 3B may be lowered so the gap 315 in the protective cover 311 aligns with and fits around the protuberance 313 of the top surface plate 307 as the cover 311 rests on the support flange 319. In this position the guide rests 321 slide down into similarly shaped guide rest notches 323 so the cover 311 can sit directly on the support flange 319.

When the telescoping arm is up the protective cover 311 is turned around 180 degrees to face the direction of FIG. 3A. The protective cover may then be lowered so the gap 315 aligns with and fits around the telescoping arm, for example, as shown in FIG. 1A. In this "up" position the guide rests 321 sit on the support flange 319 and the underside of protective cover 311 sits atop the protuberance 313. In this position the protective cover sits slightly higher than in the down position, as shown in FIG. 1A, since the underside of protective cover 111 sits on top of the protuberance. It should be noted that in both positions—the up position with the telescoping arm passing through gap 315, and the down position with the gap 315 aligns with and fitting around the protuberance 313—the protective cover 315 can be securely fastened to the top surface plate 307 by means of the fastener holes 317. The protuberance 313 is roughly the same size and shape as the cross-section of telescoping arm. In various embodiments the gap 315 is similarly shaped and slightly larger than the telescoping arm, for example, no greater than ¼ inch larger than the telescoping arm.

Various embodiments are configured such that bolts can be passed through the fastener holes 317 when the protective cover 311 is oriented in either direction as shown in FIG. 3A for the telescoping arm in the up position and in FIG. 3B for the telescoping arm in the down position. The fastener holes 317 align in either orientation with threaded holes 329 in the support flange 319 because the fastener holes 317 and the protective cover 311 itself are symmetrical about an axis 327 passing through a center of the cover. The protective cover 311 (except for gap 315 and guide rests 321) and the fastener holes 317 of protective cover 311 are also symmetric about the axis 337 perpendicular passing through the center of protective cover 311. The axis 337 is perpendicular to axis 327, and axes 327 and 337 taken together form a plane that is perpendicular to a vertical axis. Since the fastener holes 317 are symmetrical about the two perpendicular center axes of protective cover 311, the fastener holes 317 are said to be symmetrical about the center 339 of cover 311.

Only one side of the protective cover 311 has a gap configured to fit around protuberance 313 when the cover 311 is closed, covering the telescoping arm while it is in the "down" position. Other than the gap 315 within dotted line 343 and guide rests 321 the protective cover 311 is symmetric about axis 337. Since the protective cover 311 is symmetric about the two axes 327 and 337 it can be rotated 180 degrees and still fit over the access hole. The fastener holes 317 align with threaded holes 329 in the support flange 319 when the protective cover 311 is in either orientation, closed (FIG. 3B) with telescoping arm down or open (FIG. 3A) for the telescoping arm to be up. Other types of fasteners may be used to secure protective cover 311 aside from removable bolts and bolt holes 317. For example, in some embodiments the protective cover is equipped with a locking latch mechanism that slides a dead bolt beneath each side of the support flange 319, or in some implementations, beneath the edge of the top surface plate 307.

The top surface plate 307, the protective cover 311, and various other parts may be made of any durable material suitable for outdoor use, including for example, metal or various plastics, vinyls or man-made composites, or other such materials known to those of ordinary skill in the art. The top surface plate 307 and protective cover 311 are preferably constructed of materials with sufficient strength to withstand the weight of a vehicle being driven over the top of the device when it is in the down position, e.g., a lawn mower or service truck. The mechanism vault 125 should be constructed of a material that withstands corrosion since it is typically buried in the ground. Various plastics, vinyls or composites are generally suitable for this purpose.

Figure 4:
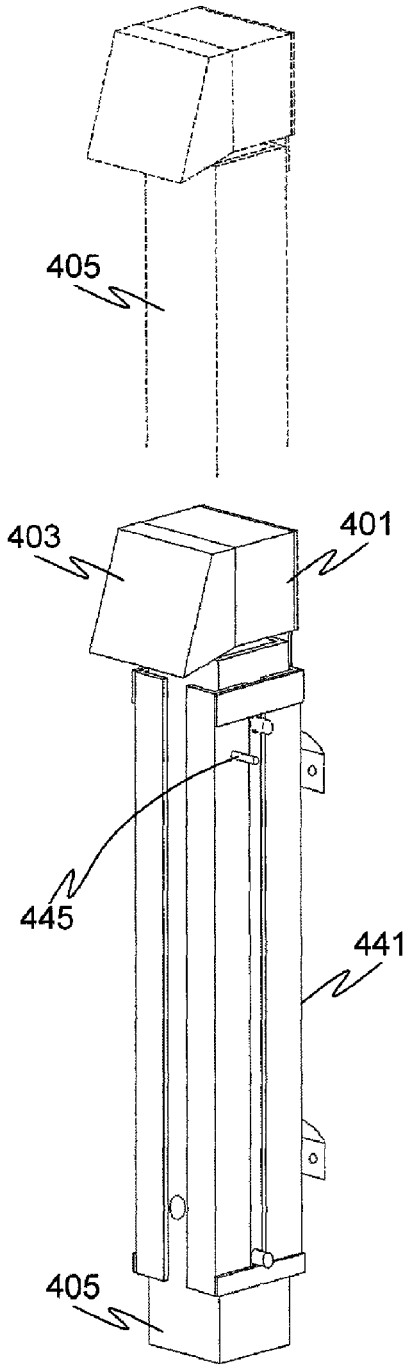
FIG. 4 depicts is the telescoping arm and guide mechanism according to various embodiments.

FIG. 4 depicts is the telescoping arm and guide mechanism according to various embodiments. The electrical box 401 with power outlets sits atop telescoping arm 405. In the "down" position electrical box 401 is stowed away within a mechanism vault. The telescoping arm 405 may be extended upward into an "up" position, as shown by the dotted lines in FIG. 4. A guide mechanism 441 is provided to support the telescoping arm 405, allowing it to slide between "up" and "down" positions. The guide mechanism 441 is typically attached to a wall of the mechanism vault and configured to rigidly hold the telescoping arm 405 in the "up" position, and also allow the telescoping arm 405 to be adjusted to the "down" position. In various embodiments the guide mechanism 441 includes a pin 445 (or bolt) that aligns with one or more holes in the telescoping arm 405 to support it in one or more positions. In some embodiments a bolt may be screwed through a threaded hole in the guide mechanism 441 to tighten against the telescoping arm 405 and hold it in any position from the "down" position to the "up" position.

Various components and activities may be included or excluded as described above, or attached or performed in a different order, with the rest of the components and activities remaining within the scope of at least one of the various embodiments. Various embodiments disclosed herein encompass retractable electrical power outlets suitable for outdoor use. By "outdoor" it is meant that the device is not located within any building and is exposed to the outdoor elements (e.g., rain, snow, temperature variations, or the like). For example, a typical outdoor setting may involve placement in a public space such as a public park, a sports field (e.g., football, baseball or soccer field), open fields, or other outdoor recreation facility such as a public swimming pool, a parking lot, or along a road or highway. The device is "retractable" inasmuch as the telescoping arm 205 may either be set in the "up" position (FIG. 2C) while using the electrical power outlets, or be set in the "down" position (FIG. 2B) for storing the device when the electrical power outlets are not being used.

Reference numbers in various figures refer to the various parts of the device. Similar reference numbers used in the different views of the figures may refer to the same part, as viewed at different angles or in a different context. For example, telescoping arm 105 of FIG. 1A is the same part as telescoping arm 205 of FIGS. 2B-C. Telescoping arm 105 is depicted from an angle in the oblique view of FIG. 1A while FIGS. 2B-C depict cutaway side views of telescoping arm 205 in the down position and up position, respectively.

The description of the various embodiments provided above is illustrative in nature inasmuch as it is not intended to limit the invention, its application, or uses. Thus, variations that do not depart from the intents or purposes of the invention are intended to be encompassed by the various embodiments of the present invention. Such variations are not to be regarded as a departure from the intended scope of the present invention.

What is claimed is:

1. A retractable outdoor electrical power receptacle comprising:

a top surface plate defining a horizontal surface level and being configured with an access hole;

a mechanism vault extending downward a predetermined length below said surface level;

a protective cover plate shaped to fit within the access hole of said top surface plate, the protective cover plate being configured to have a gap;

a telescoping arm having a top end and a bottom end and being configured to slide in a direction along a vertical axis between an up position and a down position, wherein in the up position the top end is above the surface level and the bottom end is below the surface level, and in the down position the top end and the bottom end are below the surface level;

an electrical power outlet box rigidly mounted on the top end of said telescoping arm; and a source of electrical power connected to said electrical power outlet box;

wherein the gap in the protective cover plate is configured to fit around the telescoping arm in the up position; and wherein the protective cover plate in a first position is configured to be affixed to the top surface plate by at least one fastener point with the telescoping arm in the up position passing through the gap, and the protective cover plate in a second position rotated 180 degrees from the first position is configured to cover the telescoping arm in the down position and be affixed to the top surface plate by the at least one fastener point.

2. The retractable outdoor electrical power receptacle of claim 1, wherein the access hole is symmetrical about a first horizontal axis.

3. The retractable outdoor electrical power receptacle of claim 2, wherein the mechanism vault extends downward the predetermined length in a direction of the vertical axis that is perpendicular to both the first horizontal axis and the second horizontal axis.

4. The retractable outdoor electrical power receptacle of claim 3, further comprising:

two fastener points on the protective cover plate, wherein the gap of the protective cover plate is bisected by the first horizontal axis;

wherein, with the telescoping arm in the down position, the protective cover plate is configured to fit within the access hole, and with the telescoping arm in the up position said protective cover plate is configured to fit over the access hole on top of said top surface plate.

5. The retractable outdoor electrical power receptacle of claim 2, further comprising:

a support flange located within said access hole and rigidly affixed to the mechanism vault;

wherein said protective cover plate is configured to fit within the access hole resting on top of said support flange with the telescoping arm in the down position.

6. The retractable outdoor electrical power receptacle of claim 2, further comprising:

a guide mechanism configured to hold the telescoping arm as it slides between the up position and the down position, said guide mechanism having a setting to rigidly hold the telescoping arm in the up position.

7. The retractable outdoor electrical power receptacle of claim 1, wherein the protective cover plate is symmetrical about an axis passing through a center of the gap in the protective cover plate.

8. The retractable outdoor electrical power receptacle of claim 1, wherein the electrical power outlet box comprises a face with a plurality of electrical outlets, said face being oriented parallel to said vertical axis.

9. An apparatus for supplying electrical power, comprising:

a retractable telescoping arm;

an electrical power outlet box rigidly mounted on a top end of said telescoping arm;

a mechanism vault extending downward a predetermined length below a round surface level;

a guide mechanism attached to an inside wall of the mechanism vault and configured to hold the telescoping arm either rigidly in an up position or in a down position;

a protective cover plate shaped to fit over an access hole of the mechanism vault, the protective cover plate being configured to have a gap slightly larger than the telescoping arm;

at least two guide rests affixed to a bottom side of said protective cover plate; and a support flange beneath the access hole of the mechanism vault having at least two guide rests notches;

wherein the telescoping arm is configured to slide between the up position and the down position while being supported by the guide mechanism;

wherein, with the telescoping arm in the down position, said protective cover plate is configured to fit within the access hole with the bottom side of said protective cover plate resting on said support flange and the at least two guide rests fitting within the at least two guide rests notches; and wherein, with the telescoping arm in the up position, said protective cover plate is configured to fit above the access hole with the bottom side of said protective cover plate resting on a protuberance and the at least two guide rests resting on said support flange.

10. The apparatus of claim 9, wherein the gap is no greater than ¼ inch larger than the telescoping arm and is similarly shaped to a cross-section of the telescoping arm.

11. The apparatus of claim 9, wherein the telescoping arm has a bottom end opposite the top end; and wherein in the up position the top end is above the surface level and the bottom end is below the surface level, and in the down position the top end and the bottom end are below the surface level.

12. The apparatus of claim 9, wherein the guide mechanism is configured to hold the telescoping arm as it slides between the up position and the down position, said guide mechanism having a setting to rigidly hold the telescoping arm in the up position.

13. The apparatus of claim 9, wherein the protective cover plate is symmetrical about an axis passing through a center of the gap in the protective cover plate.

14. The apparatus of claim 9, wherein the electrical power outlet box comprises a face with a plurality of electrical outlets, said face being oriented parallel to said vertical axis.

* * * * *